US006135736A

United States Patent [19]

Tucker, Jr. et al.

[11] Patent Number: 6,135,736

[45] Date of Patent: Oct. 24, 2000

[54] SCROLL MACHINE WITH NON-MACHINED ANTI-THRUST SURFACE

[75] Inventors: Richard S. Tucker, Jr., Quincy; Kent E. Logan, Englewood, both of Ohio

[73] Assignee: Copeland Corporation, Sidney, Ohio

[21] Appl. No.: 08/955,406

[22] Filed: Oct. 23, 1997

[51] Int. Cl.[7] ..... F01C 1/04; F01C 21/08

[52] U.S. Cl. ..... 418/55.2

[58] Field of Search ..... 418/55.2, 55

[56] References Cited

U.S. PATENT DOCUMENTS 4,303,379 12/1981 Hiraga et al. .
4,304,535 12/1981 Terauchi .
4,403,494 9/1983 McCullough .
4,433,564 2/1984 Fukushima et al. .
4,436,465 3/1984 Fukushima et al. .
4,443,166 4/1984 Ikegawa et al. .
4,487,248 12/1984 Fukushima et al. .
4,666,380 5/1987 Hirano et al. .
4,824,345 4/1989 Fukuhara et al. .
5,730,588 3/1998 Terai et al. ..... 418/55.2
5,791,887 8/1998 Williams et al. ..... 418/55.2

*Primary Examiner*—Timothy S. Thorpe
*Assistant Examiner*—Liem Nguyen
*Attorney, Agent, or Firm*—Harness, Dickey & Pierce, P.L.C.

[57] ABSTRACT

A scroll machine has a first scroll member and a second scroll member. The end plates of at least one of the scroll members is only machined in the area which interfaces with the wrap tip of the opposing scroll member. A clearance gap is maintained everywhere else in order to ensure sealing occurs.

21 Claims, 2 Drawing Sheets

SCROLL MACHINE WITH NON-MACHINED ANTI-THRUST SURFACE

FIELD OF THE INVENTION

The present invention relates to scroll machines. More particularly, the present invention relates to scroll compressors having a non-machined anti-thrust surface located on one or both of the orbiting and non-orbiting scroll members.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate a pair of intermeshed spiral wraps, one of which is caused to orbit relative to the other so as to define one or more moving chambers which progressively decrease in size as they travel from an outer suction port toward a center discharge port. An electric motor is provided which operates to drive the orbiting scroll member via a suitable drive shaft affixed to the motor rotor. In a hermetic compressor, the bottom of the hermetic shell normally contains an oil sump for lubricating and cooling purposes.

Scroll compressors depend upon a number of seals to be created to define the moving or successive chambers. One type of seals which must be created are the seals between opposed flank surfaces of the wraps. These flank seals are created adjacent to the outer suction port and travel radially inward along the flank surface due to the orbiting movement of one scroll with respect to the other scroll. Additional sealing is required between the end plate of one scroll and the tip of the wrap of the other scroll. These tip seals have been the subject of numerous designs and developments in the scroll compressor field.

One solution to the creation of tip seals has been to machine a groove in the end surface of the wrap and insert a sealing member which can be biased away from the wrap and towards the end plate of the opposite scroll. Unfortunately, due to the complex shape of the wraps themselves, the machining of the groove, the manufacture of the sealing member and the assembly of these components, the costs associated with incorporating tip seals are excessive. Although expensive, tip seals have performed satisfactorily in creating the required sealing between the tip of the wrap and the opposing end plate.

Other designs for scroll compressors have incorporated axial biasing of one scroll with respect to the opposing scroll. The axial biasing operates to urge the tips of the scroll members against their opposing end plate in order to enhance the sealing at the tip of the wrap. The biasing of one scroll member with respect to the opposing scroll member in conjunction with dimensional control of the scroll members themselves has allowed scroll compressors to be manufactured without separate sealing members between the tip of the wrap and the opposing end plate.

The present invention provides the art with a scroll compressor which eliminates a significant amount of machining of the end plate. The end plates of the scroll members are only machined in the area which interface with the opposing scroll wrap. The remaining surface area of the end plates is left unmachined with the height of the scroll wraps being sufficient to avoid undesired contact between the two scrolls. In this manner, the scroll wraps support the entire biasing load between the two scrolls.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
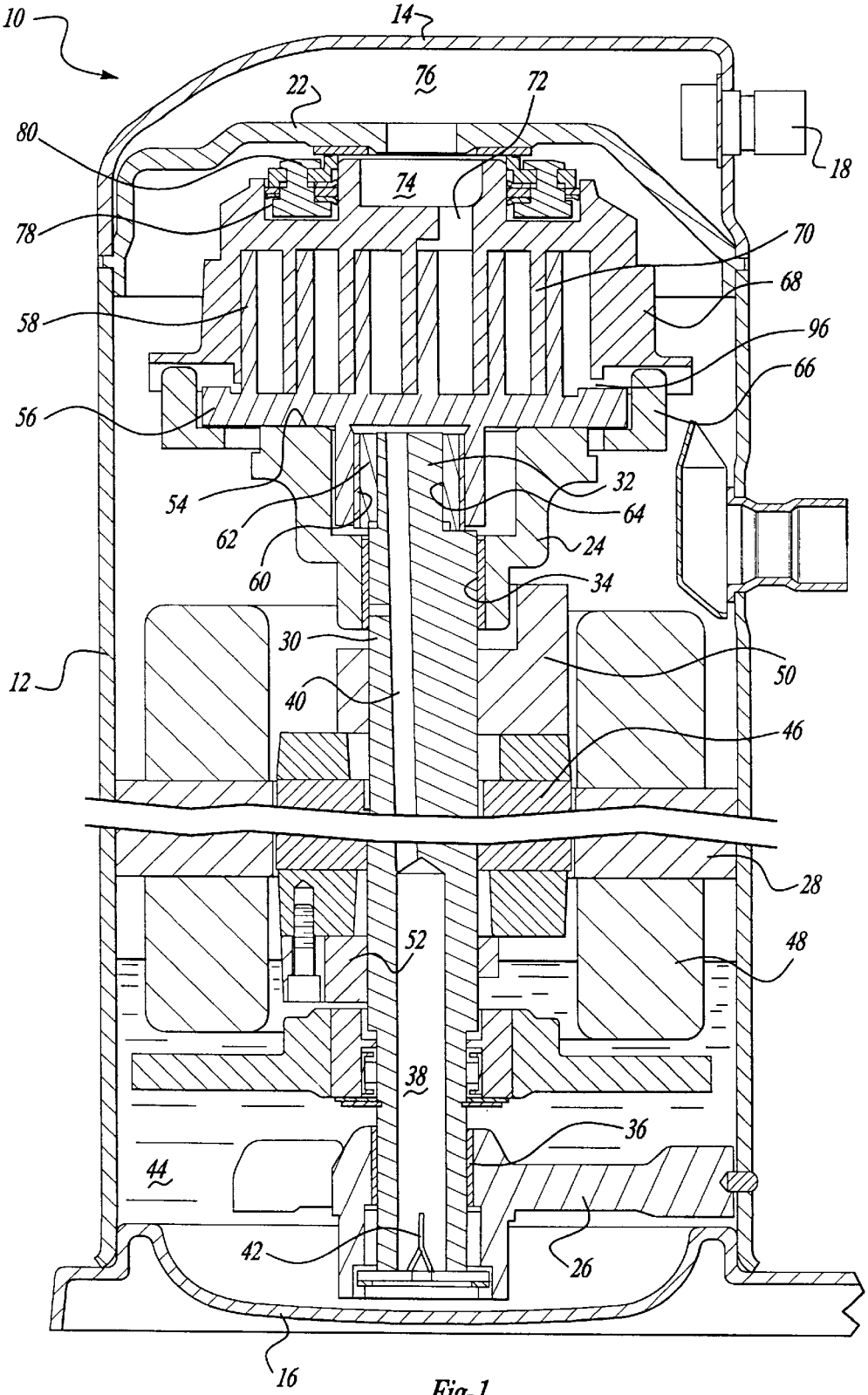
FIG. 1 is a vertical cross-sectional view through the center of a scroll type refrigeration compressor incorporating a non-machined anti-thrust surface in accordance with the present invention.

Referring now to the drawings in which like reference numerals designate like or corresponding parts throughout the several views, there is shown in FIG. 1 a scroll compressor which incorporates the non-machined anti-thrust surface in accordance with the present invention which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12 and a lower bearing housing 26 also having a plurality of radially outwardly extending legs each of which is also suitably secured to shell 12. A motor stator 28 which is generally square in cross-section but with the corners rounded off is press fitted into shell 12. The flats between the rounded corners on the stator provide passageways between the stator and shell, which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. Disposed within bore 38 is a stirrer 42. The lower portion of the interior shell 12 defines an oil sump 44 which is filled with lubricating oil to a level slightly above the lower end of a rotor 46, and bore 38 acts as a pump to pump lubricating fluid up the crankshaft 30 and into passageway 40 and ultimately to all of the various portions of the compressor which require lubrication.

Crankshaft 30 is rotatively driven by an electric motor including stator 28, windings 48 passing therethrough and rotor 46 press fitted on the crankshaft 30 and having upper and lower counterweights 50 and 52, respectively.

The upper surface of main bearing housing 24 is provided with a flat thrust bearing surface 54 on which is disposed an orbiting scroll member 56 having the usual spiral vane or wrap 58 on the upper surface thereof. Projecting downwardly from the lower surface of orbiting scroll member 56 is a cylindrical hub having a journal bearing 60 therein and in which is rotatively disposed a drive bushing 62 having an inner bore 64 in which crank pin 32 is drivingly disposed. Crank pin 32 has a flat on one surface which drivingly engages a flat surface (not shown) formed in a portion of bore 64 to provide a radially compliant driving arrangement, such as shown in assignee's U.S. Pat. No. 4,877,382, the disclosure of which is hereby incorporated herein by reference. An Oldham coupling 66 is also provided positioned between orbiting scroll member 56 and bearing housing 24 and keyed to orbiting scroll member 56 and a non-orbiting scroll member 68 to prevent rotational movement of orbiting scroll member 56. Oldham coupling 66 is preferably of the type disclosed in assignee's copending U.S. Pat. No. 5,320,506, the disclosure of which is hereby incorporated herein by reference.

Non-orbiting scroll member 68 is also provided having a wrap 70 positioned in meshing engagement with wrap 58 of orbiting scroll member 56. Non-orbiting scroll member 68 has a centrally disposed discharge passage 72 which communicates with an upwardly open recess 74 which in turn is in fluid communication with a discharge muffler chamber 76 defined by cap 14 and partition 22. An annular recess 78 is also formed in non-orbiting scroll member 68 within which is disposed a seal assembly 80. Recesses 74 and 78 and seal assembly 80 cooperate to define axial pressure biasing chambers which receive pressurized fluid being compressed by wraps 58 and 70 so as to exert an axial biasing force on non-orbiting scroll member 68 to thereby urge the tips of respective wraps 58, 70 into sealing engagement with the opposed end plate surfaces. Seal assembly 80 is preferably of the type described in greater detail in U.S. Pat. No. 5,156,539, the disclosure of which is hereby incorporated herein by reference. Non-orbiting scroll member 68 is designed to be mounted to bearing housing 24 in a suitable manner such as disclosed in the aforementioned U.S. Pat. No. 4,877,382 or U.S. Pat. No. 5,102,316, the disclosure of which is hereby incorporated herein by reference.

Figure 2:
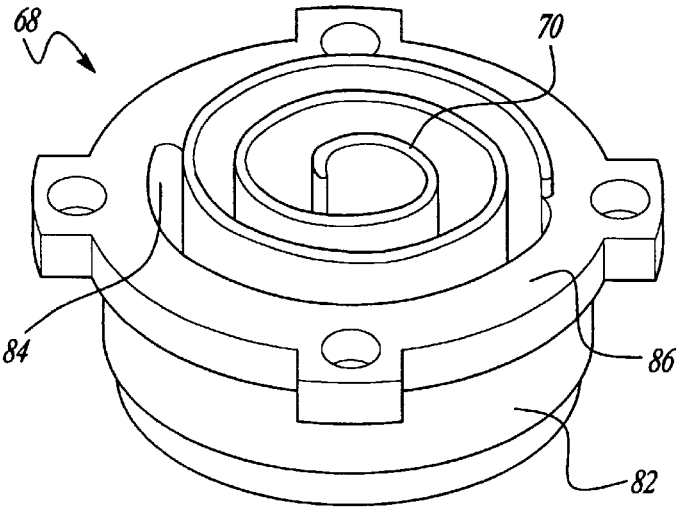
FIG. 2 is a perspective view of the non-orbiting scroll illustrated in FIG. 1 showing the non-machined anti-thrust surface.
Figure 3:
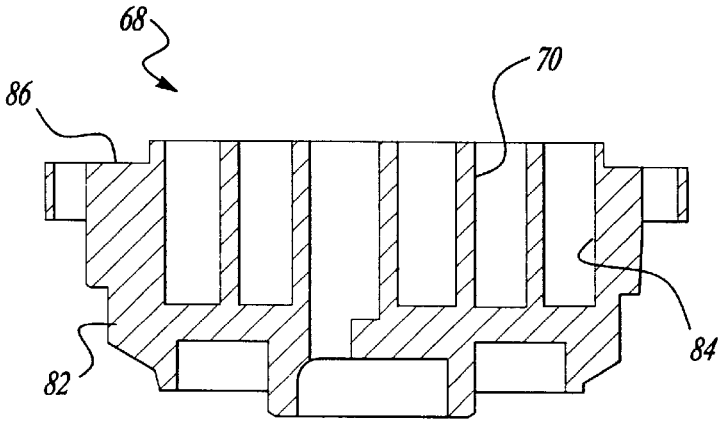
FIG. 3 is a cross-sectional view of the non-orbiting scroll shown in FIG. 2.

Referring now to FIGS. 2 and 3, non-orbiting scroll member 68 includes a housing 82 which defines a pocket 84 which creates non-orbiting scroll wrap 70. Housing 82 includes an anti-thrust surface 86 which is left in its as-cast or non-machined condition. The machining of surface 86 can be eliminated because non-orbiting scroll wrap 70 extends beyond surface 86 as shown in FIG. 3 thus enabling the tip of wrap 70 to contact the end plate of orbiting scroll member 56 without having surface 86 contact orbiting scroll member 56 as shown in FIG. 1.

Figure 4:
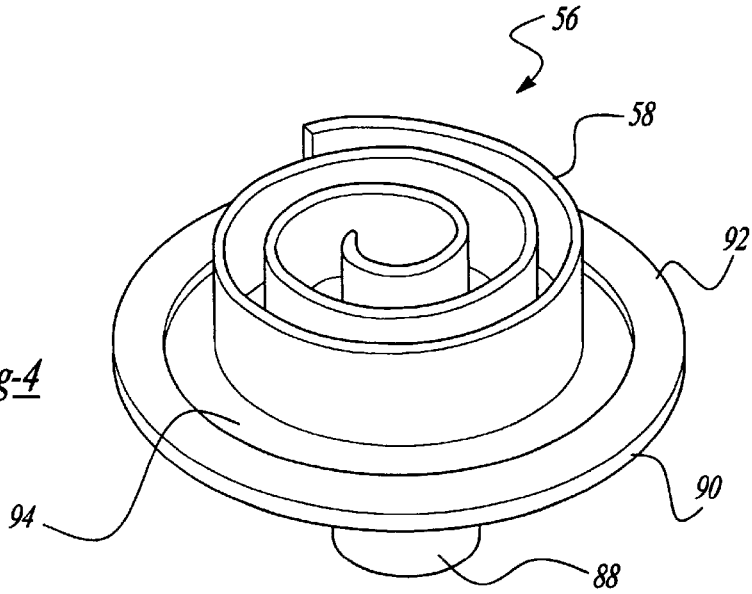
FIG. 4 is a perspective view of the orbiting scroll illustrated in FIG. 1 showing the non-machined anti-thrust surface.

Referring now to FIG. 4, orbiting scroll member 56 is shown. Orbiting scroll member 56 includes a housing 88 which includes an end plate 90 from which orbiting scroll wrap 58 extends. Housing 88 includes an anti-thrust surface 92 which is left in its as-cast or non-machined condition. The machining of the entire surface 92 can be eliminated because during the machining of orbiting scroll wrap 58, a recessed area 94 is machined into end plate 90. Recessed area 94 is configured to accept non-orbiting scroll wrap 70 of non-orbiting scroll member 68 during the orbital movement of orbiting scroll member 56 with respect to non-orbiting scroll member 68. The depth of recessed area 94 is smaller than the amount by which non-orbiting scroll wrap 70 of non-orbiting scroll member 68 extends above surface 86. In this way a gap 96 (shown in FIG. 1) is created between non-machined surface 86 and non-machined surface 92 allowing for the elimination of machining of these two surfaces. In addition, gap 96 allows for a limited amount of wear between scroll wrap 58 and the bottom of pocket 84 as well as a limited amount of wear between scroll wrap 70 and recessed area 94.

Both non-orbiting scroll member 68 and orbiting scroll member 56 are manufactured using a near-net weight manufacturing process which produces a blank or preform which requires a minimum of machining. The near-net weight process could be a powdered metal process, a die casting process, a lost foam casting process or any other process having a ability of create the near-net weight blank or preform. The near-net weight blank or preform allows the manufacturer to only machine critical areas of the blank in order to finish of the component. Thus, the overall manufacturing costs associated with the manufacturer of the component can be significantly reduced.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a shell;

a first scroll member disposed within said shell, said first scroll member having a first end plate and a first spiral wrap projecting outwardly from said first end plate to define a wrap tip, said first scroll member including a first non-machined surface completely surrounding said first spiral wrap;

a second scroll member disposed within said shell, said second scroll member having a second spiral wrap projecting outwardly from a second end plate, said second spiral wrap intermeshed with said first spiral wrap; and a drive member for causing said scroll members to orbit relative to one another whereby said spiral wraps will create pockets of progressively changing volume between a suction pressure zone and a discharge pressure zone.

2. The scroll machine according to claim 1 wherein, said second end plate includes a second non-machined surface at least partially surrounding said second spiral wrap.

3. The scroll machine according to claim 2 wherein, said second end plate includes a machined surface adjacent to said second spiral wrap.

4. The scroll machine according to claim 2 wherein, said second non-machined surface is spaced from said first non-machined surface to form a clearance gap.

5. The scroll machine according to claim 2 wherein, said second non-machined surface completely surrounds said second scroll wrap.

6. The scroll machine according to claim 5 wherein, said first non-machined surface completely surrounds said first scroll wrap.

7. The scroll machine according to claim 1 wherein, said first scroll member includes an annular wall surrounding said first and second spiral wraps.

8. The scroll machine according to claim 1 wherein, said first scroll member is a non-orbiting scroll.

9. A scroll machine comprising:

a shell;

a first scroll member disposed within said shell, said first scroll member having a first spiral wrap projecting outwardly from a first end plate, said first scroll member including a machined surface surrounding said first spiral wrap and a first non-machined surface completely surrounding said machined surface;

a second scroll member disposed within said shell, said second scroll member having a second spiral wrap projecting outwardly from a second end plate, said second spiral wrap intermeshed with said first spiral wrap;

a drive member for causing said scroll members to orbit relative to one another whereby said spiral wraps will create pockets of progressively changing volume between a suction pressure zone and a discharge pressure zone.

10. The scroll machine according to claim 9 wherein, said second scroll member includes a second non-machined surface at least partially surrounding said second spiral wrap.

11. The scroll machine according to claim 10 wherein, said second non-machined surface is spaced from said first non-machined surface to form a clearance gap.

12. The scroll machine according to claim 10 wherein, said second non-machined surface completely surrounds said second scroll wrap.

13. The scroll machine according to claim 12 wherein, said first non-machined surface completely surrounds said first scroll wrap.

14. The scroll machine according to claim 9 wherein, said first scroll member includes an annular wall surrounding said first and second spiral wraps.

15. The scroll machine according to claim 9 wherein, said first scroll member is an orbiting scroll.

16. A scroll machine comprising:

a shell;

a first scroll member disposed within said shell, said first scroll member having a first end plate and a first spiral wrap projecting outwardly from said first end plate to define a wrap tip, said first scroll member including an annular wall surrounding said first spiral wrap, said annular wall having a first non-machined surface at least partially surrounding said first spiral wrap adjacent to said wrap tip;

a second scroll machine disposed within said shell, said second scroll member having a second spiral wrap projecting outwardly from a second end plate, said second spiral wrap intermeshed with said first spiral wrap; and a drive member for causing said scroll members to orbit relative to one another whereby said spiral wraps will create pockets of progressively changing volume between a suction pressure zone and a discharge pressure zone.

17. The scroll machine according to claim 16 wherein, said second end plate includes a second non-machined surface at least partially surrounding said second spiral wrap.

18. The scroll machine according to claim 16 wherein, said first scroll member is a non-orbiting scroll.

19. A scroll machine comprising:

a shell;

a first scroll member disposed within said shell, said first scroll member having a first end plate and a first spiral wrap projecting outwardly from said first end plate to define a wrap tip, said first scroll member including a first non-machined surface at least partially surrounding said first spiral wrap adjacent to said wrap tip;

a second scroll machine disposed within said shell, said second scroll member having a second spiral wrap projecting outwardly from a second end plate, said second spiral wrap intermeshed with said first spiral wrap, said second end plate including a second non-machined surface at least partially surrounding said second spiral wrap, said second non-machined surface being spaced from said first non-machined surface to form a clearance gap; and a drive member for causing said scroll members to orbit relative to one another whereby said spiral wraps will create pockets of progressively changing volume between a suction pressure zone and a discharge pressure zone.

20. A scroll machine comprising:

a shell;

a first scroll member disposed within said shell, said first scroll member having a first spiral wrap projecting outwardly from a first end plate, said first scroll member including a machined surface surrounding said first spiral wrap and a first non-machined surface at least partially surrounding said machined surface;

a second scroll member disposed within said shell, said second scroll member having a second spiral wrap projecting outwardly from a second end plate, said second spiral wrap intermeshed with said first spiral wrap, said second scroll member including a second non-machined surface at least partially surrounding said second spiral wrap, said second non-machined surface being spaced from said first non-machined surface to form a clearance gap; and a drive member for causing said scroll members to orbit relative to one another whereby said spiral wraps will create pockets of progressively changing volume between a suction pressure zone and a discharge pressure zone.

21. The scroll machine according to claim 20 wherein, said second non-machined surface completely surrounds said second scroll wrap.

* * * * *

UNITED STATES PATENT AND TRADEMARK OFFICE

CERTIFICATE OF CORRECTION

PATENT NO. : 6,135,736

DATED : October 24, 2000

INVENTOR(S) : Richard S. Tucker, Jr. et al

It is certified that error appears in the above-identified patent and that said Letters Patent is hereby corrected as shown below:

Column 4, line 9, "a" should be -- an --.

Column 4, line 9, "of" should be -- to --.

Column 4, line 12, "of" should be deleted.

Column 4, line 13, "manufacturer" should be -- manufacture --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*